United States Patent [19]

Evans

[11] Patent Number: 5,072,576

[45] Date of Patent: Dec. 17, 1991

[54] NEWSPAPER BUNDLER

[75] Inventor: David L. Evans, Acton, Mass.

[73] Assignee: Tucker Housewares, Leominster, Mass.

[21] Appl. No.: 588,687

[22] Filed: Sep. 26, 1990

[51] Int. Cl.[5] ..... B65B 27/08; B65B 13/00

[52] U.S. Cl. ..... 53/592; 53/390

[58] Field of Search ..... 53/592, 590, 390, 399, 53/586, 582, 528

[56] References Cited

U.S. PATENT DOCUMENTS

| | | | |
|---|---|---|---|
| 3,059,386 | 10/1962 | Vorrath et al. | 53/592 X |
| 4,603,542 | 8/1986 | Reiter et al. | 53/592 X |
| 4,681,032 | 7/1987 | McDermott | 53/592 X |

OTHER PUBLICATIONS

Label from Stak-N-Tie by Akro-Mills 1 page).

*Primary Examiner*—James F. Coan

*Attorney, Agent, or Firm*—Darby & Darby

[57] ABSTRACT

A bundler for newspapers having a newspaper holding container formed by front, back and side walls and a bottom wall section at each corner. Two adjacent walls of said front, back and side walls have a cord holding compartment below the container bottom wall sections and a hollow pedestal base extends from and below said container bottom wall between each said compartment and the opposite wall of the container. The cord is placed out from each compartment into the container, across the interior of the pedestal base below the container bottom wall and up over the opposing wall with the newspapers resting on the bottom wall sections. The cords are pulled upwardly around the bundle and are cut and tied.

14 Claims, 3 Drawing Sheets

NEWSPAPER BUNDLER

BACKGROUND OF THE INVENTION

A need exists in many instances for a simple apparatus to aid a user in the bundling of various articles, for example, newspapers. With the present trend toward recycling, many communities and municipalities have instituted regulations wherein a homeowner or commercial property operator must tie up articles such as newspapers into bundles before they will be accepted for collection.

Consequently, a device to aid a user in bundling up articles such as newspapers in a simple manner would be useful. Heretofore, the usual method for bundling newspapers generally followed stacking the papers on a bench or on the floor into a bundle and tying the bundles with cord or string unwound from a ball or spool. Such a method, while operative, is inconvenient from the point of view of having to perform the added step of collecting loose newspapers for the bundle and manipulating the bundle of loose papers during the tying operation. This places physical stress and strain on the user.

The prior method and also in not able to provide a single storage space for the newspapers which is also useful during the bundling and tying steps. That is, newspapers are stored in a separate location, often scattered widely about, and then must be assembled for tying up into a bundle.

BRIEF DESCRIPTION OF THE INVENTION

The present invention relates to an apparatus which is particularly useful for tying newspaper into a bundle. The apparatus comprises a container in which the newspapers are stored prior to their being tied into a bundle. This provides an advantage in that the apparatus has a self-contained storage space.

Integral with the container for holding the newspapers are a pair of compartments each for holding a spool of cord for tying up the bundle. The compartments are located below the newspaper holding container and along mutually perpendicular axes these axes generally corresponding to the middle of the width and height of the newspaper. A hollow pedestal base for the bundler to rest on a surface is also below the newspaper container. The cord is played out from each of the spools in the respective compartments, laid in the pedestal below the container and then passed out over an opposite side of the container. When the newspapers are placed in the container, they rest on the container bottom above the two cords which are at right angles to each other. Upon the container being filled with the newspapers to the desired height for tying the bundle, the cords entering over the walls of the container are cut and are tied with the free end of each of the cords which has exited from the side of the container opposite from the side in which the cord spool was located.

Accordingly, a simple, novel and useful apparatus is provided for tying newspapers into bundles in which the cords are self-contained, the newspapers are automatically stacked for tying, and the cords are in a position which permits easy tying and completion of the finished bundle.

OBJECTS OF THE INVENTION

It is an object of the present invention to provide an apparatus for facilitating tying bundles of articles, such as newspapers.

A further object is to provide a newspaper tying apparatus including a container into which the newspapers are stacked, the container having a cord carrying compartment on two of the adjacent walls thereof from which cord is supplied to tie the bundle.

Another object is to provide a container for holding newspapers in a stack in which they are to be tied, the container having a cord spool storage compartment on two orthogonal walls thereof, a cord from each compartment being laid in a hollow pedestal base below the container and over the opposing container wall, with the newspapers being laid on the container bottom wall above the cords.

Yet another object is to provide a molded plastic newspaper bundler with self-contained compartments for the cord to tie the newspapers into a bundle.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
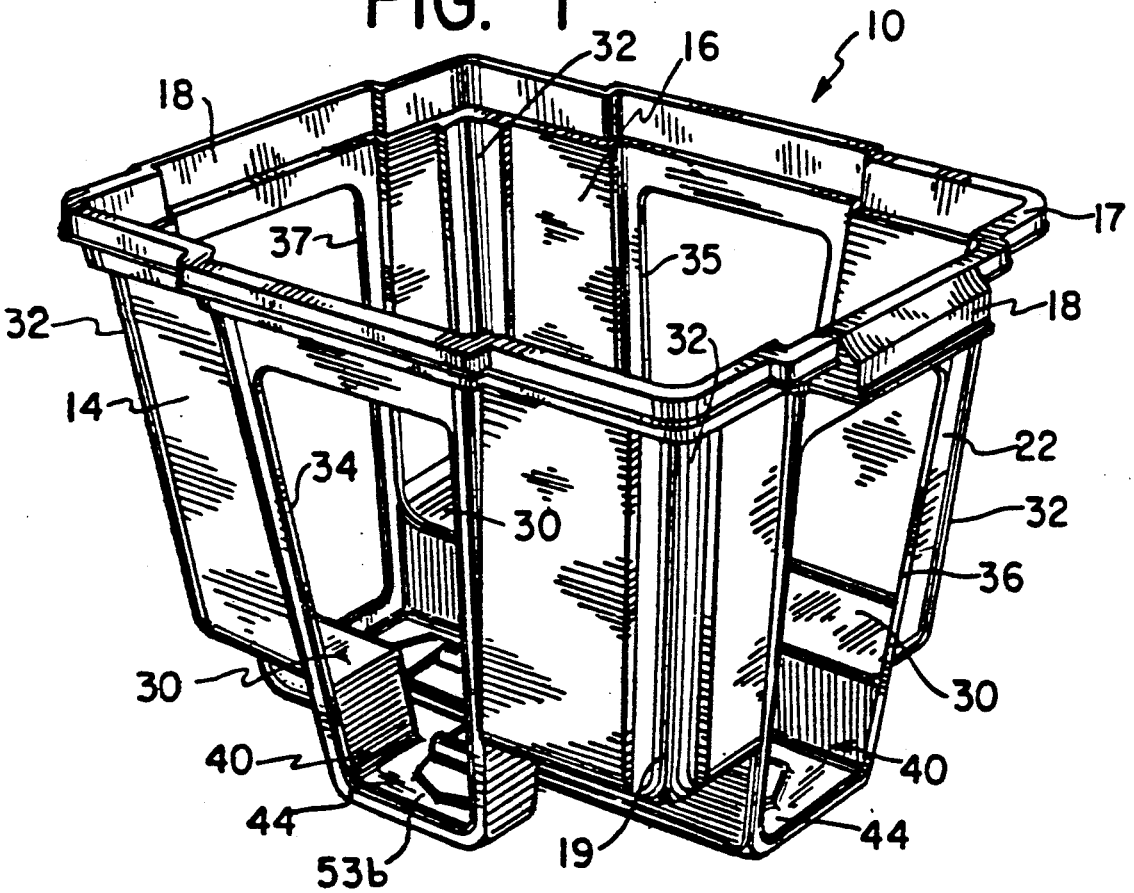
FIG. 1 is a perspective view of the bundler in an empty condition.
Figure 1A:
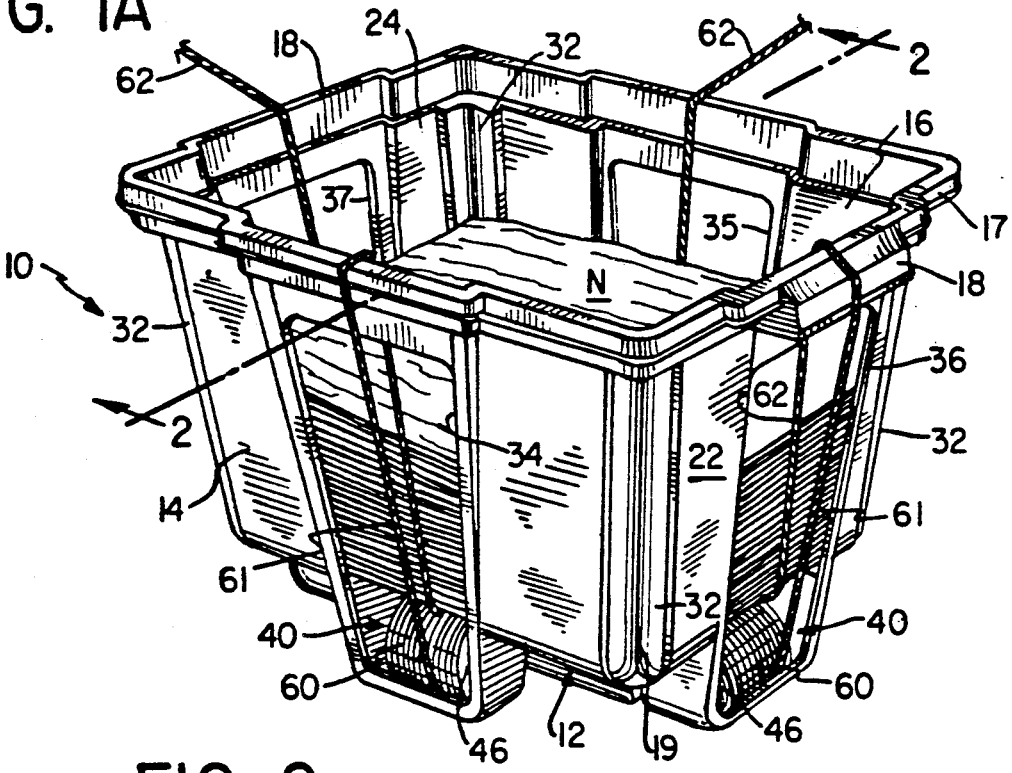
FIG. 1A is a perspective view of the bundler with the cord supply reels and newspapers.
Figure 2:
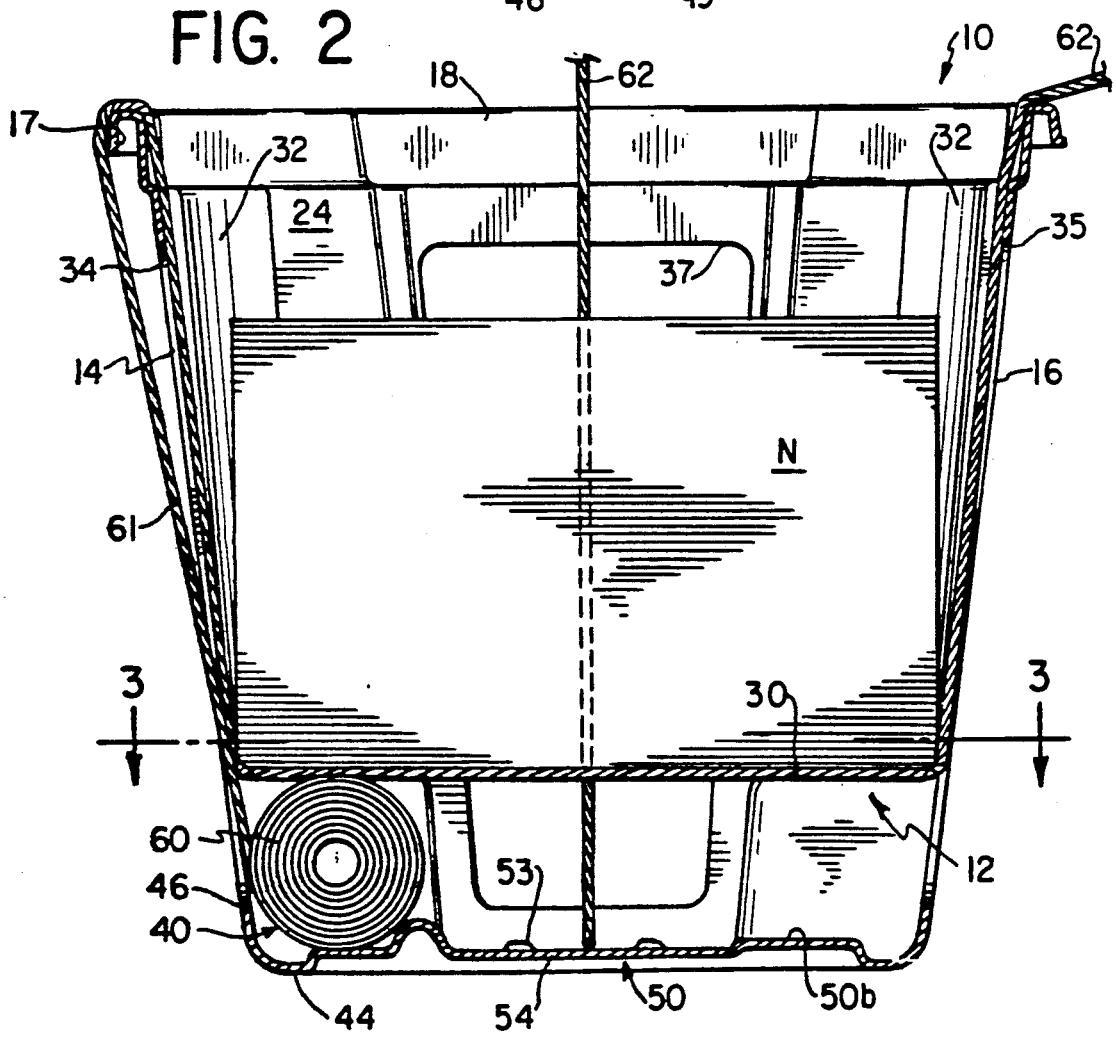
FIG. 2 is an elevational view in cross section approximately at the mid-point of the container along lines 2—2 of FIG. 1.
Figure 3:
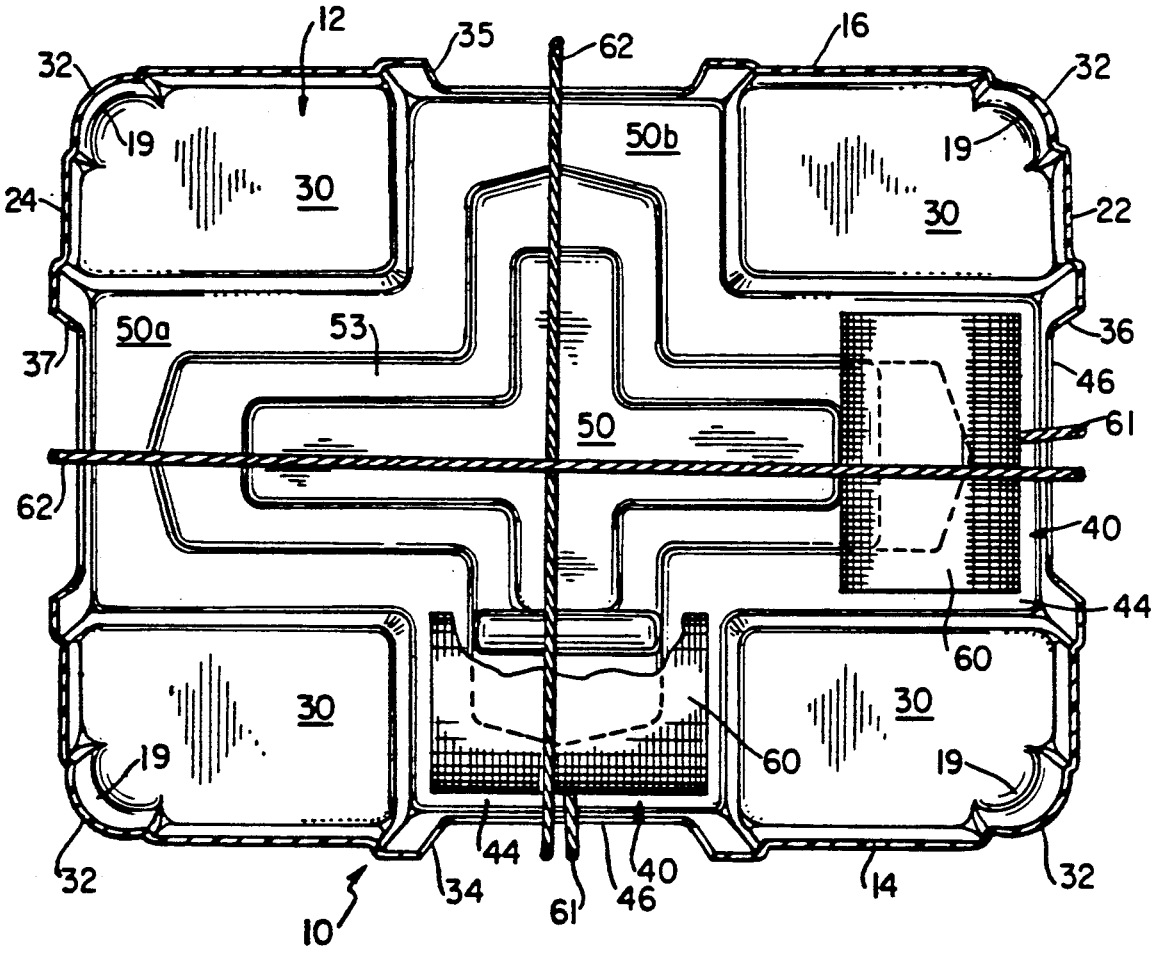
FIG. 3 is a cross-sectional view taken along lines 3—3 of FIG. 2 showing the bottom of the bundler.

Referring to FIGS. 1-3, the bundler 10 is a one piece structure which is preferably made of a suitable plastic material such as polyethylene, polypropylene or some combination thereof by any suitable process, for example, injection molding.

The bundler 10 has a newspaper container portion 12 with a front wall 14, rear wall 16 and connecting side walls 22 and 24. The side walls 22, 24 are generally orthogonal to the front and rear walls to form a rectangular structure. The walls 14, 16, 22 and 24 are slanted inwardly somewhat so that the top of the bundler is wider. This permits a plurality of bundlers to be nested one within another for shipping.

The container portion 12 of the bundler 10 is completed by a bottom wall 30 which is formed of four generally rectangular sections, one at each corner where a front or back wall and a side wall meet. The sections form a bottom wall 30 which is of the general size of the newspapers which are to be stacked in the bundler. A raised stiffening rib 32 surrounds each of the bottom wall corner sections 30. The container portion 12 of the bundler is approximately 5/6 to ¾ of the overall height of the bundler. The front, back and sidewalls are joined at a corner 19 which is generally arcuate, for structural purposes, each end of the arc of a corner terminating at a small indent or instep to the respective wall. This further increases the structural strength at each corner.

A down turned peripheral rim 17 is formed on the upper edge of each of walls 14, 16, 22, 24. Also, formed from on rim 17 on the side walls 22, 24 is an outwardly extending handle portion 18 which permits the bundler to be grasped and moved or carried by the user.

Extending downwardly from and between container bottom wall corner sections 30 is a hollow pedestal base 50 having a section 50*a* which extends part way across the length of the bundler and a section 50*b* which extends part way across the width. These pedestal sections 50*a*, 50*b* are generally at right angles to each other to form a single continuous pedestal. A cross-shaped stiffening rib 53 is formed on the pedestal base bottom wall 54, this generally corresponding to the shape of the pedestal base 50. The pedestal base 50 supports the bundler on a floor or another surface.

Each of the front and back walls 14, 16, is formed with a respective window 34, 35 which extends vertically along the height of the corresponding wall and is somewhat tapered in shape from a wider portion at the top going toward a narrower portion toward the bottom of the wall. Each of the side walls 22, 24 is formed with a similar window 36, 37. The top of each of the windows 36 and 37 is essentially as wide as the handles 18 on the side walls and they also taper from a wider portion at the top to a narrower portion toward the bottom. Each of the windows 34, 35, 36, 37 provides access to the interior of the container so that the newspapers located within the container can be manipulated.

One of the front or back walls 12, 16, here shown as the front wall 12, is formed with a cord spool holding compartment 40 having side walls extending below the container bottom wall 30 and terminating in a bottom wall 44 which is an extension of and is at the same level as the pedestal base 50 bottom wall 54. Similarly, one of the side walls, here shown as the side wall 22, also has a similar compartment 40 with a bottom wall 44. The cord holding compartments 40 are extensions of the hollow pedestal base and the bottom walls 44 of the compartments 40 are flush with the bottom wall 54 of the pedestal base 50. Thus, the bundler 10 rests not only on the pedestal base 50 bottom walls 54 but also on the bottom walls 44 of the two compartments 40. The lower parts of the windows 34, 36 form the openings into the compartments 40.

The height of each of the compartments 40 from its bottom wall 44 to the bottom wall 30 of the container is sufficient to hold a spool of cord 60 which is shown as being a generally cylindrical roll. Each of the windows 34 and 36 has a lipped edge 46 surrounding the compartment 40 so that the spool of cord will be held in the compartment when the bundler is moved. The reel of cord 60 is compressed and/or tilted at a angle and more or less forced into its compartment 40.

As shown in the various figures, the supply end 61 of the cord which comes off of spool 60 in the compartment 40 of the front wall 12 is played out upwardly along the outside of the wall 12, over the lip edge 17 of that wall, placed freely in and across the section of the pedestal base section 50*b* to the inside of the opposing container back wall 16 opposite the spool. The free end 12 of the cord exits over the ledge 17 on the back wall 16. As seen, the cord within the bundler is below container bottom wall sections 30.

Similarly, the supply end 61 of the cord supply 60 in the compartment 40 of side wall 22 is played out over the top of the handle 18 and rim 17, extends across the width of the bundler within the pedestal base section 50*a* and the free end 62 exits from within the container over the opposite side wall 24. If desired, notches can be formed in the top edge of the rim 17 where the cord is to pass over to properly locate the cords.

In operation, the user sets the cords from the two spools 60 in the position as previously discussed. He thereafter inserts the newspapers N into the container 12 where the bottommost paper comes to rest on the corner bottom sections 30. The following papers are automatically stacked in reasonable order in view of the shape of the container 12 generally corresponding to that of the shape and size of a newspaper.

After the papers have been stacked into the container to the desired bundle height, additional cord can be pulled for the spool by pulling on the free end 62. The cord can be pulled since it is within the free area of the hollow pedestal and is not trapped between the stacked newspapers and the container bottom wall sections 30. The user then cuts off the cord at the supply roll end, for example, close to the exit of the cord from the roll. The user then takes the free end 62 and with the cut supply end 61 pulls the cord tight to engage the bottom of the paper stack and then ties a knot on the top of the bundle.

FIG. 3 shows the cord going from the front to back walls 14, 16 already having been pulled tight while the cord between the side walls 22, 24 is still in the original loading position. The ends of both cords are tied so that the usual two tied cords at right angles is produced. Thereafter, the user merely lifts the tied bundle out of the container 12 and the bundler 10 is now free to accept papers so that another bundle can be stacked and tied. Alternatively, the bundler 10 can be used as the receptacle which is placed at the trash pickup location.

It is also possible to store a cutting tool as part of the bundler. For example, a cutting blade can be stored in a frame molded into the rim 17 adjacent the location where the cord passes over the rim.

What is claimed is:

1. An article bundler comprising:

a container having upwardly extending connected front, rear and side walls and a bottom onto which the article is to be placed, the upper edges of the container front, rear and side walls being connected by a continuous peripheral rim, a hollow pedestal base extending below said bottom and having its own bottom wall to rest on a surface, at least one compartment extending from one of said container front, rear and side walls below said container bottom for holding a supply of cord, said compartment formed by opposed side walls extending below said container bottom and a bottom cross piece connecting said compartment side walls.

2. An article bundler as in claim 1 wherein the cord from the supply in the cord holding compartment extends upwardly over the top of the continuous peripheral rim on the wall from which the compartment extends, then downwardly into and across the interior of the hollow pedestal base and then upwardly over the peripheral rim on the opposing container wall.

3. An article bundler as in claim 1 further comprising handle means on the rim for lifting the bundler.

4. An article bundler as in claim 1 wherein said cord holding compartment cross piece is an extension of the pedestal base bottom wall.

5. An article bundler as in claim 1 wherein the container wall from which the cord holding compartment extends has a window opening which extends from adjacent to the rim at the top of said container wall to the bottom cross-piece of said cord holding compartment.

6. An article bundler as in claim 1 wherein there is one cord holding compartment extending from one of said container front and back walls and another cord holding compartment extending from one of said container side walls.

7. An article bundler as in claim 5 wherein each of said cord holding compartments is formed by opposed side walls extending below said container bottom, and a bottom cross piece.

8. An article bundler as in claim 7 wherein the container wall to which each cord holding compartment is attached has a window opening which extends from adjacent to the rim at the top of said container wall to the bottom cross-piece of said cord holding compartment.

9. An article bundler comprising:

a container having upwardly extending and connected front, rear and side walls and a bottom onto which the article is to be placed, the upper edges of the front, rear and side walls being connected by a continuous peripheral rim;

a cord holding compartment below said container bottom extending from one of said container front and back walls and another cord holding compartment below said bottom extending from one of said container side walls.

10. An article bundler as in claim 9 wherein there is one cord holding compartment extending from one of said container front and back walls and another cord holding compartment extending from one of said container side walls, each of said cord holding compartments is formed by opposed side walls extending below said container bottom, and a bottom cross piece, and further comprising a hollow pedestal base which extends from and below said container bottom and between the bottom cross piece of each said cord holding compartment and toward the opposite container wall, said pedestal base having a bottom wall to rest on a surface.

11. An article bundler as in claim 10 wherein the cord from the supply in each compartment extends upwardly to the rim of the top of the wall to which the compartment is attached, then downwardly over the rim into and across the interior of the hollow pedestal base and then upwardly over the rim of the opposing wall.

12. An article holder as in claim 9 wherein there is a handle means on the rim of at least one of the container walls.

13. An article bundler as in claim 10 further comprising handle means on opposing walls of one of the pairs of side walls and front and back walls.

14. An article bundler comprising:

a container having upwardly extending connected front, rear and side walls having a continuous rim connecting the upper periphery thereof and a bottom onto which the article is to be placed, a hollow pedestal base extending below said bottom and having its own bottom wall to rest on a surface, at least one compartment extending from one of said container walls below said container bottom and down to an extension of the pedestal bottom walls for holding a supply of cord, said compartment formed by opposed side walls extending below said container bottom and a bottom cross piece extending from the pedestal bottom wall connecting said compartment side walls, the container wall from which the compartment extends split into two sections between the peripheral rim to the compartment cross-piece to define an access window into the container above its bottom and into the compartment.

* * * * *